US006834645B2

(12) United States Patent
Takizawa et al.

(10) Patent No.: US 6,834,645 B2
(45) Date of Patent: Dec. 28, 2004

(54) FUEL SUPPLY CONTROL SYSTEM FOR INTERNAL COMBUSTION ENGINE

(75) Inventors: Osamu Takizawa, Wako (JP); Yuji Yasui, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 118 days.

(21) Appl. No.: 10/290,394

(22) Filed: Nov. 8, 2002

(65) Prior Publication Data

US 2003/0089357 A1 May 15, 2003

(30) Foreign Application Priority Data

Nov. 9, 2001 (JP) ..... 2001-344596
Oct. 4, 2002 (JP) ..... 2002-291818

(51) Int. Cl.[7] ..... F02D 41/00
(52) U.S. Cl. ..... 123/674; 123/479; 701/109
(58) Field of Search ..... 123/674, 688, 123/690, 698, 479, 480, 672; 701/109, 114, 104, 107

(56) References Cited

U.S. PATENT DOCUMENTS 6,003,308 A 12/1999 Tsutsumi et al.
2003/0070667 A1 * 4/2003 Yasui et al. ..... 123/674

FOREIGN PATENT DOCUMENTS

| | | |
|---|---|---|
| DE | 37 43 907 C 2 | 7/1988 |
| DE | 40 01 494 C 3 | 8/1990 |
| JP | 63167051 A | 7/1988 |
| JP | 01253546 A | 10/1989 |
| JP | 7-23702 | 3/1995 |
| JP | 8-6623 | 1/1996 |

* cited by examiner

*Primary Examiner*—Mahmoud Gimie
*Assistant Examiner*—Arnold Castro
(74) *Attorney, Agent, or Firm*—Squire, Sanders & Dempsey LLP

(57) ABSTRACT

A fuel supply control system for an internal combustion engine wherein a basic fuel amount supplied to said engine can be calculated according to the intake air flow rate detected by said intake air flow rate sensor. An air-fuel ratio correction coefficient can be calculated for correcting an amount of fuel to be supplied to the engine so that the detected air-fuel ratio coincides with a target air-fuel ratio. At least one correlation parameter vector which defines a correlation between the air-fuel ratio correction coefficient and the intake air flow rate detected by the intake air flow sensor, can be calculated using a sequential statistical processing algorithm. A learning correction coefficient relating to a change in characteristics of the intake air flow rate sensor can be calculated using the correlation parameter. An amount fuel to be supplied to the engine can be controlled using the basic fuel amount, the air-fuel ratio correction coefficient, and the learning correction coefficient.

27 Claims, 9 Drawing Sheets

FUEL SUPPLY CONTROL SYSTEM FOR INTERNAL COMBUSTION ENGINE

BACKGROUND OF THE INVENTION

The present invention relates to a fuel supply control system for an internal combustion engine, and more particularly to a fuel supply control system in which an intake air flow rate of the internal combustion engine is detected by an intake air flow rate sensor, and an amount of fuel to be supplied to the engine is controlled according to the detected intake air flow rate.

A method of detecting an intake air flow rate of the internal combustion engine with a hotwire flow meter is conventionally known. The characteristic of the hotwire flow meter changes due to aging. Therefore, there is a problem of a detection error of the intake air flow rate increasing, if the hotwire flow meter is being used for a long time. To cope with this problem, a method of calculating a learning correction value according to changes in the characteristic of the hotwire flow meter is shown in Japanese Patent Laid-Open (Kokoku) Hei 7-23702.

According to this method, an air-fuel ratio negative feedback amount CFB is calculated according to an output of an air-fuel ratio sensor provided in an exhaust system of the internal combustion engine, so that the detected air-fuel ratio coincides with a target value. Further, a plurality of values CL1, CL2, and CL3 of the air-fuel ratio negative feedback amount CFB, which correspond respectively to a plurality of flow rate points QL1, QL2, and QL3, representative of the characteristic change in the hotwire flow meter, are stored in a memory. The learning correction value is calculated by means of the interpolation or extrapolation according to the data stored in the memory and the intake air flow rate Q detected by the hotwire flow meter.

In the method shown in Japanese Patent Laid-Open (Kokoku) Hei 7-23702, the values CL1, CL2, and CL3 of the air-fuel ratio negative feedback amount CFB corresponding to the predetermined flow rate points QL1, QL2, and QL3 are stored in the memory, and the stored data are used for calculation of the learning correction value. Accordingly, if the values CL1, CL2, and CL3 of the air-fuel ratio negative feedback amount CFB in the memory change due to a change in the engine operating condition, the learning correction value directly reflects the changes in the values CL1, CL2, and CL3, which results in a large variation in the learning correction value. In addition, according to this method, the characteristic change in the hotwire flow meter is monitored in the plurality of flow rate points QL1, QL2, and QL3. When increasing the number of the monitoring points in order to improve accuracy of the learning correction value, the memory capacity increases. Accordingly, from the view point of manufacturing costs, it is not preferable to greatly increase the number of the monitoring points.

The recent tightening of emission regulations (harmful gas emission) has highlighted that the deterioration or the characteristic change in parts of the engine or the engine control devices, causes an adverse effect on the exhaust characteristics of the engine. Therefore, it is desirable to obtain the learning correction coefficient with a higher degree of accuracy depending on the characteristic change in the intake air flow rate sensor.

A method of determining an abnormality or a deterioration in the intake air flow rate sensor is known from Japanese Patent Laid-Open (Kokoku) Hei 8-6623. In this method, the abnormality or the deterioration is detected based on the detected values of the air-fuel ratio sensor, the throttle valve opening sensor, and the engine rotational speed sensor.

According to this determining method of the characteristic deterioration (abnormality) of the intake air flow rate sensor, the determination is performed not with the statistically processed data of the sensor detected values, but with the sensor detected values themselves. Therefore, there is a problem of the determination accuracy becoming lower, when the frequency of the determination is increased.

BRIEF SUMMARY OF THE INVENTION

A first object of the present invention is to provide a fuel supply control system for an internal combustion engine, which can obtain an accurate learning correction value that compensates for an influence of the characteristic change in the intake air flow rate sensor, to thereby maintain good controllability of the air-fuel ratio control.

A second object of the present invention is to provide a fuel supply control system for an internal combustion engine, which can regularly monitor an operation of the intake air flow rate sensor to accurately determine an abnormality in the intake air flow rate sensor.

To achieve the first object, the present invention provides a fuel supply control system for an internal combustion engine, including intake air flow rate detecting means, basic fuel amount calculating means, an air-fuel ratio sensor provided in an exhaust system of the engine, air-fuel ratio correction coefficient calculating means, correlation parameter calculating means, learning means, and fuel amount control means. The intake air flow rate detecting means detects an intake air flow rate (QAIR) of the engine. The basic fuel amount calculating means calculates a basic fuel amount (TIM) supplied to the engine, according to the intake air flow rate (QAIR) detected by the intake air flow rate detecting means. The air-fuel ratio correction coefficient calculating means calculates an air-fuel ratio correction coefficient (KAF) for correcting an amount of fuel to be supplied to the engine so that the air-fuel ratio detected by the air-fuel ratio sensor coincides with a target air-fuel ratio. The correlation parameter calculating means calculates at least one correlation parameter vector ($\theta 1$, $\theta 2$) which defines a correlation between the air-fuel ratio correction coefficient (KAF) and the intake air flow rate (QAIR) detected by the intake air flow rate detecting means, using a sequential statistical processing algorithm. The learning means calculates a learning correction coefficient (KREFG) relating to a change in characteristics of the intake air flow rate detecting means, using the at least one correlation parameter vector ($\theta 1$, $\theta 2$). The fuel amount control means controls an amount (TOUT) of fuel to be supplied to the engine, using the basic fuel amount (TIM), the air-fuel ratio correction coefficient (KAF), and the learning correction coefficient (KREFG).

With this configuration, at least one correlation parameter vector which defines a correlation between the air-fuel correction coefficient, which corrects an amount of fuel supplied to the engine so that the air-fuel ratio coincides with the target air-fuel ratio, and the intake air flow rate detected by the intake air flow rate detecting means, can be calculated using the sequential statistical processing algorithm. Further, the learning correction coefficient relating to a change in characteristics of the intake air flow rate detecting means can be calculated using the at least one correlation parameter vector. The amount of fuel to be supplied to the engine is controlled using the air-fuel ratio correction coefficient, the learning correction coefficient, and the basic fuel amount, which can be set according to the intake air flow rate detected by the intake air flow rate detecting means. That is, at least one correlation parameter vector is calculated with the statistical processing based on many detected data, and the learning correction coefficient is calculated using the calculated correlation parameter vector. Therefore, it is possible to obtain the learning correction coefficient with a high degree of accuracy that corresponds to an averaged state of the ever-changing engine operating conditions. In addition, since the sequential statistical processing algorithm is used, no special computing device such as a CPU is required for statistical processing, and the computation for the statistical processing can be executed with a relatively small memory capacity.

Preferably, the fuel supply control system further includes abnormality determining means for determining an abnormality in the intake air flow rate detecting means according to an element (A1, A2) of the at least one correlation parameter vector (θ1, θ2).

With this configuration, the abnormality in the intake air flow rate detecting means can be determined according to the element of the at least one correlation parameter vector. Accordingly, the operation of the intake air flow rate detecting means is regularly monitored to increase frequency of the abnormality determination and improve accuracy of the abnormality determination.

Preferably, the correlation parameter calculating means calculates a plurality of correlation parameter vectors (θ1, θ2) corresponding to a plurality of operating regions (R1, R2) of the engine.

With this configuration, a high degree of accuracy of the learning correction coefficient can be maintained over a wide range of the engine operating conditions.

Preferably, the correlation parameter calculating means calculates a plurality of correlation parameter vectors (θ1, θ2), each of which defines the correlation with a linear expression, and the learning means switches the correlation parameter vector (θ1, θ2) that is used for calculating the learning correction coefficient (KREFG), at an intersection (PX) of straight lines (LR1, LR2) corresponding to the linear expressions.

With this configuration, the correlation parameter vector that is used for calculating the learning correction coefficient can be switched at an intersection of the straight lines corresponding to a plurality of the correlation parameter vector. Accordingly, the learning correction coefficient is prevented from abruptly changing when the correlation parameter vector is switched, which then results in a smooth switching.

Preferably, the correlation parameter calculating means calculates the correlation parameter vector (θ1, θ2), when the engine is operating in a predetermined operating condition.

With this configuration, the correlation parameter vector is calculated when the engine is operating in the predetermined operating condition. Accordingly, the correlation parameter vector is accurately calculated which improves accuracy of the learning correction.

Preferably, the correlation parameter calculating means calculates a modified air-fuel ratio correction coefficient (KAFMOD) by modifying the air-fuel ratio correction coefficient (KAF) with the learning correction coefficient (KREFG), and calculates the correlation parameter vector (θ1, θ2), using the modified air-fuel ratio correction coefficient (KAFMOD).

With this configuration, the air-fuel ratio correction coefficient can be modified by the learning correction coefficient to thereby calculate the modified air-fuel ratio correction coefficient. Then, the correlation parameter vector can be calculated using the modified air-fuel ratio correction coefficient instead of the air-fuel ratio correction coefficient. If the air-fuel ratio correction coefficient itself is used, there is a possibility that the learning control by the learning correction coefficient may result in a hunting condition. The hunting condition is an attempt to establish the learning correction coefficient in order to calculate the correlation parameter vector. Such a problem can be avoided by using the modified air-fuel ratio correction coefficient.

Preferably, the correlation parameter calculating means calculates the correlation parameter vector (θ1, θ2), using a deviation (KAF-1) between the air-fuel ratio correction coefficient (KAF) and a central value of the air-fuel ratio correction coefficient.

With this configuration, the deviation between the air-fuel ratio correction coefficient and a central value of the air-fuel ratio correction coefficient is used instead of only the air-fuel ratio correction, coefficient to calculate the correlation parameter vector. The deviation varies around zero which is the center of the variation range. Accordingly, the correlation parameter vector can be obtained with a higher degree of accuracy, when using the sequential statistical processing algorithm.

Preferably, the correlation parameter calculating means uses the sequential statistical processing algorithm, limiting values of elements (A1, B1, A2, B2) of the correlation parameter vector (θ1, θ2) within a predetermined range. Accordingly, a stable correlation parameter vector can be obtained.

To achieve the second object, the present invention provides a fuel supply control system for an internal combustion engine, including intake air flow rate detecting means, basic fuel amount calculating means, an air-fuel ratio sensor provided in an exhaust system of the engine, air-fuel ratio correction coefficient calculating means, correlation parameter calculating means, fuel amount control means, and abnormality determining means. The intake air flow rate detecting means detects an intake air flow rate (QAIR) of the engine. The basic fuel amount calculating means calculates a basic fuel amount (TIM) supplied to the engine, according to the intake air flow rate (QAIR) detected by the intake air flow rate detecting means. The air-fuel ratio correction coefficient calculating means calculates an air-fuel ratio correction coefficient (KAF) for correcting an amount of fuel to be supplied to the engine so that the air-fuel ratio detected by the air-fuel ratio sensor coincides with a target air-fuel ratio. The correlation parameter calculating means calculates at least one correlation parameter vector (θ1, θ2) which defines a correlation between the air-fuel ratio correction coefficient (KAF) and the intake air flow rate (QAIR) detected by the intake air flow rate detecting means, using a sequential statistical processing algorithm. The fuel amount control means controls an amount (TOUT) of fuel to be supplied to the engine, using the basic fuel amount (TIM) and the air-fuel ratio correction coefficient (KAF). The abnormality determining means determines an abnormality in the intake air flow rate detecting means according to an element (A1, A2) of the at least one correlation parameter vector (θ1, θ2).

With this configuration, at least one correlation parameter vector is calculated using the sequential statistical processing algorithm. The correlation parameter defines a correlation between the air-fuel correction coefficient, which corrects an amount of fuel supplied to the engine so that the air-fuel ratio coincides with the target air-fuel ratio, and the intake air flow rate detected by the intake air flow rate detecting means. The amount of fuel to be supplied to the engine is controlled using the air-fuel ratio correction coefficient and the basic fuel amount which is set according to the intake air flow rate detected by the intake air flow rate detecting means. Further, an abnormality in the intake air flow rate detecting means can be determined according to the element of the at least one correlation parameter vector. As a result, the operation of the intake air flow rate detecting means is regularly monitored to improve accuracy of the abnormality determination.

DETAILED DESCRIPTION OF THE INVENTION

Some embodiments of the present invention will now be described with reference to the drawings.

First Embodiment

Figure 1:
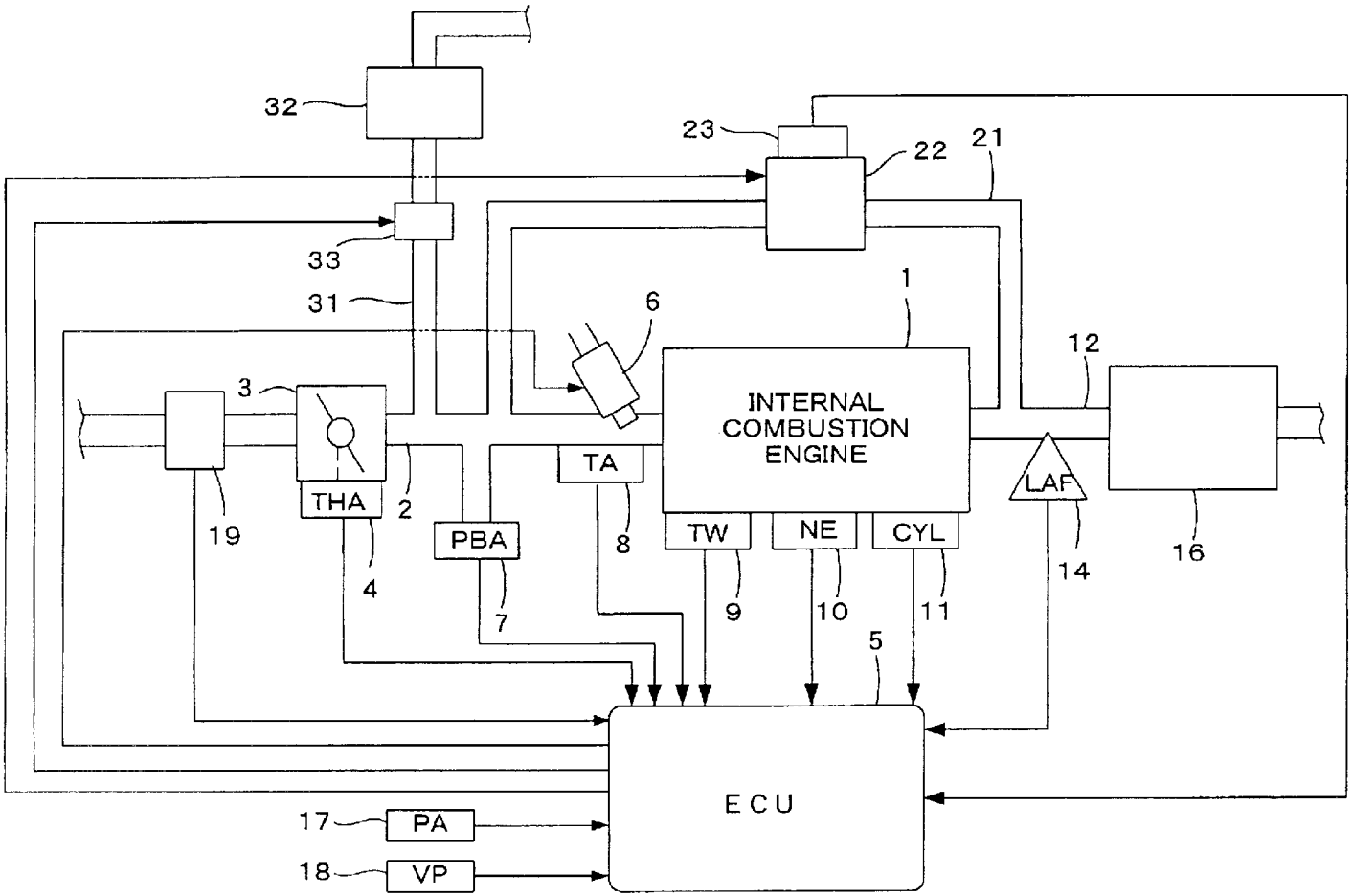
FIG. 1 is a diagram showing a configuration of an internal combustion engine and a control system therefor according to a first embodiment of the present invention.

FIG. 1 illustrates a general configuration of an internal combustion engine (engine) and a control system therefor according to a first embodiment of the present invention. The engine can be a four-cylinder engine 1, for example, having an intake pipe 2 provided with a throttle valve 3. A throttle opening sensor (THA) 4 can be connected to the throttle valve 3, so as to output an electrical signal corresponding to an opening of the throttle valve 3 and supply the electrical signal to an electronic control unit (ECU) 5.

The intake pipe 2 can be provided with an intake air flow rate sensor 19 at a location upstream of the throttle valve 3. The output signal of the intake air flow rate sensor 19 is supplied to the ECU 5.

Fuel injection valves 6, only one of which is shown, are inserted into the intake pipe 2 at locations intermediate between the cylinder block of the engine 1 and the throttle valve 3 and slightly upstream of the respective intake valves (not shown). These fuel injection valves 6 can be connected to a fuel pump (not shown), and electrically connected to the ECU 5. A valve opening period of each fuel injection valve 6 can be controlled by a signal output from the ECU 5.

An absolute intake pressure sensor (PBA) 7 can be provided immediately downstream of the throttle valve 3. An absolute pressure signal converted to an electrical signal by the absolute intake pressure sensor 7, is supplied to the ECU 5. An intake air temperature sensor (TA) 8 can be provided downstream of the absolute intake pressure sensor 7 to detect an intake air temperature TA. An electrical signal corresponding to the detected intake air temperature TA, is output from the sensor 8 and supplied to the ECU 5.

An engine coolant temperature sensor (TW) 9 such as a thermistor can be mounted on the body of the engine 1 to detect an engine coolant temperature (cooling water temperature) TW. A temperature signal corresponding to the detected engine coolant temperature TW is output from the sensor 9 and supplied to the ECU 5.

An engine rotational speed sensor (NE) 10 and a cylinder discrimination sensor (CYL) 11 can be mounted to face to a camshaft or a crankshaft (both not shown) of the engine 1. The engine rotational speed sensor 10 outputs a top dead center (TDC) signal pulse at a crank angle position located at a predetermined crank angle before the TDC corresponding to the start of an intake stroke of each cylinder of the engine 1 (at every 180° crank angle in the case of a four-cylinder engine). The cylinder discrimination sensor 11 outputs a cylinder discrimination signal pulse at a predetermined crank angle position for a specific cylinder of engine 1. The sensors 10 and 11 are supplied to the ECU 5.

An exhaust pipe 12 of the engine 1 can be provided with a three-way catalyst 16 for reducing NOx, HC, and CO contained in exhaust gases. A proportional type air-fuel ratio sensor (LAF sensor) 14 can be mounted on the exhaust pipe 12 at a position upstream of the three-way catalyst 16. The LAF sensor 14 outputs an electrical signal substantially proportional to the oxygen concentration (air-fuel ratio) in the exhaust gases, and supplies the electrical signal to the ECU 5.

An exhaust gas recirculation passage 21 can be connected between a portion of the intake pipe 2 downstream of the throttle valve 3 and a portion of the exhaust pipe 12 upstream of the three-way catalyst 16. The exhaust gas recirculation passage 21 can be provided with an exhaust gas recirculation valve (EGR valve) 22 for controlling an exhaust gas recirculation amount. The EGR valve 22 can be an electromagnetic valve having a solenoid, and its valve opening degree can be controlled by the ECU 5. The EGR valve 22 can be provided with a lift sensor 23 for detecting the valve opening degree (valve lift amount) LACT of the EGR valve 22, and a detection signal from the lift sensor 23 is supplied to the ECU 5. The exhaust gas recirculation passage 21 and the EGR valve 22 constitute an exhaust gas recirculation mechanism.

A canister 32 can be connected to a fuel tank (not shown) to store evaporative fuel generated inside the fuel tank. The canister 32 contains for example an adsorbent for adsorbing the evaporative fuel. The canister 32 can be connected through a purging passage 31 to the intake pipe 2 at a position downstream of the throttle valve 3. The purging passage 31 can be provided with a purge control valve 33. The purge control valve 33 can be a solenoid valve capable of continuously controlling the flow rate by changing the on-off duty ratio of a control signal received. The operation of the purge control valve 33 can be controlled by the ECU 5. Alternatively, the purge control valve 33 may be provided by a solenoid valve whose valve opening degree is continuously variable. In this case, the above-mentioned on-off duty ratio corresponds to the valve opening degree in such a continuously variable valve opening type solenoid valve. The purging passage 31, the canister 32, and the purge control valve 33 constitute an evaporative fuel processing system.

An atmospheric pressure sensor 17 for detecting an atmospheric pressure PA and a vehicle speed sensor 18 for detecting a vehicle speed VP of a vehicle driven by the engine 1 can be connected to the ECU 5. Detection signals from these sensors 17 and 18 are supplied to the ECU 5.

The ECU 5 includes an input circuit having various functions including shaping the waveforms of input signals from the various sensors, correcting the voltage levels of the input signals to a predetermined level, and converting analog signal values into digital signal values. The ECU 5 can further include a central processing unit (CPU), a memory circuit, and an output circuit. The memory circuit preliminarily stores various operational programs to be executed by the CPU and stores the results of the computation or the like by the CPU. The output circuit supplies drive signals to the fuel injection valves 6, the EGR valve 22, and the purge control valve 33.

The ECU 5 determines various engine operating conditions according to the output signals from the sensors mentioned above, to supply a control signal to the solenoid of the EGR valve 22. Specifically, the ECU 5 can set a valve lift command value LCMD according to the engine rotational speed NE and the absolute intake pressure PBA, and can control the EGR valve 22 so that a deviation between the valve lift command value LCMD and an actual valve lift amount LACT detected by the lift sensor 23, becomes zero.

The CPU in the ECU 5 determines various engine operating conditions according to the output signals from the sensors mentioned above, and computes a fuel injection period TOUT of each fuel injection valve 6 to be opened in synchronism with the TDC signal pulse. The fuel injection period TOUT is calculated from Eq. (1) described below, according to the above determined engine operating conditions.

$$TOUT=TIM\times KAF\times KREFG\times KEGR\times KPURGE\times K1+K2 \quad (1)$$

where:

TIM is a basic fuel injection period of each fuel injection valve 6;

KAF is an air-fuel ratio correction coefficient;

KREFG is a learning correction coefficient;

KEGR is an EGR correction coefficient;

KPURGE is a purge correction coefficient; and

K1 is another correction coefficient and K2 is a correction variable.

The basic fuel injection period TIM is determined by retrieving a TI table set according to the intake air flow rate QAIR. The TI table can be set soo that the air-fuel ratio of an air-fuel mixture to be supplied to the engine 1 becomes substantially equal to the stoichiometric ratio.

KAF can be set so that the air-fuel ratio detected by the LAF sensor 14 coincides with a target air-fuel ratio. When the feedback control according to the output from the LAF sensor 14 is not performed, the air-fuel ratio correction coefficient KAF can be set to "1.0".

KREFG can be introduced to compensate for a deviation in the feedback control by the air-fuel ratio correction coefficient KAF. The learning correction coefficient KREFG is effective when the detecting characteristic of the intake air flow rate sensor 19 is different from the preliminarily assumed average characteristic, due to characteristic differences in mass-produced intake air flow rate sensor, or aging of the intake air flow rate sensor. A specific calculation method for this coefficient will be hereinafter described.

KEGR can be set to 1.0 (noncorrection value) when exhaust gas recirculation is not carried out (when the EGR valve 22 is closed), or set to a value smaller than 1.0 when exhaust gas recirculation is carried out (when the EGR valve 22 is opened) to decrease a fuel injection amount with a decrease in intake air amount.

KPURGE can be set to "1.0" when the purge control valve 33 is closed. when the purge control valve 33 is opened to supply the evaporative fuel to the intake pipe 2, KPURGE is set so that the fuel injection amount is decreased according to an increase in amount of the evaporative fuel supplied.

The correction coefficient K1 and the correction variable K2 are determined to such values as to optimize various characteristics such as fuel consumption characteristics and engine acceleration characteristics according to engine operating conditions.

The CPU supplies a drive signal for opening each fuel injection valve 6 according to the fuel injection period TOUT obtained above to the fuel injection valve 6.

This embodiment employs a new calculation method for the learning correction coefficient KREFG which is applied to Eq. (1). This calculation method will now be described.

Figure 2:
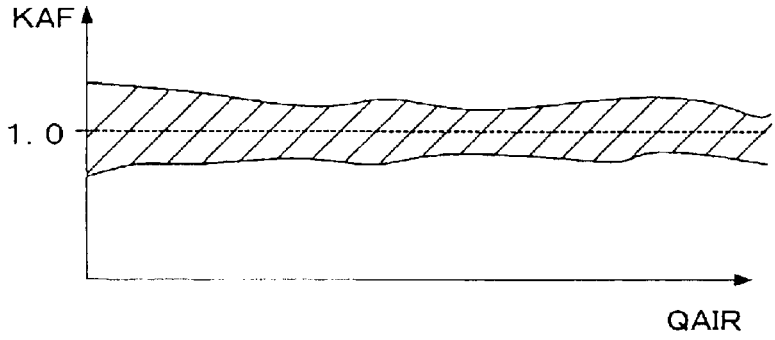
FIG. 2 is a graph showing a relation between an air-fuel ratio correction coefficient (KAF) and an intake air flow rate (QAIR) detected by a intake air flow rate sensor in a normal condition.

FIG. 2 illustrates the case where the intake air flow rate sensor 19 is normal (not deteriorated), the relation between a detected intake air flow rate QAIR and an air-fuel ratio correction coefficient KAF. In FIG. 2, the hatched region indicates a range of values of the air-fuel ratio correction coefficient KAF corresponding to the intake air flow rate QAIR. As apparent from FIG. 2, the air-fuel ratio correction coefficient KAF is maintained at a substantially constant value in the vicinity of "1.0" irrespective of changes in the intake air flow rate QAIR. The intake air flow rate QAIR shown in FIG. 2 is not an actual intake air flow rate, but an intake air flow rate which is detected by the intake air flow rate sensor 19. The actual intake air flow rate will be referred to as "QAIRA" in the following description.

When the intake air flow rate sensor 19 is deteriorated (e.g., dust has adhered to the hotwire in the hotwire flow rate sensor), an error (a deviation) between the detected intake air flow rate QAIR and the actual intake air flow rate QAIRA increases, so that the air-fuel ratio changes to a value which is richer or leaner than a target value. As a result, the air-fuel ratio correction coefficient KAF increases or decrease to compensate for this shift of the air-fuel ratio.

When the intake air flow rate sensor 19 is deteriorated, a detection error ERR, which is defined by the equation shown below, tends to become negative (the detected intake air flow rate QAIR becomes greater than the actual intake air flow rate QAIRA) in the range where the actual intake air flow rate QAIRA is small.

$$ERR=QAIRA-QAIR$$

Figure 3:
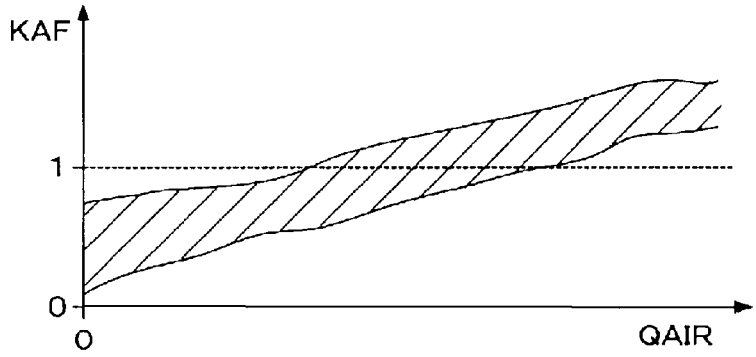
FIG. 3 is a graph showing a relation between the air-fuel ratio correction coefficient (KAF) and the intake air flow rate (QAIR) detected by the intake air flow rate sensor in an abnormal condition.

In contrast, the detection error ERR tends to become positive, in the range where the actual intake air flow rate QAIRA is large. This occurs, for example, when the detected intake air flow rate QAIR becomes less than the actual intake air flow rate QAIRA. As a result, a positive correlation characteristic of the intake air flow rate QAIR and the air-fuel ratio correction coefficient KAF is obtained as shown in FIG. 3. That is, in the range where the actual intake air flow rate QAIRA is small, the detected intake air flow rate QAIR becomes greater than the actual intake air flow rate QAIRA and the basic fuel injection period TIM becomes greater than the optimum value, so that the air-fuel ratio correction coefficient KAF becomes less than "1.0". In the range where the actual intake air flow rate QAIRA is large, the detected intake air flow rate QAIR becomes less than the actual intake air flow rate QAIRA and the basic fuel injection period TIM becomes less than the optimum value, so that the air-fuel ration correction coefficient KAF becomes greater than "1.0".

It should be noted that a negative correlation characteristic of the intake air flow rate QAIR and the air-fuel ratio correction coefficient KAF, which is an inverse correlation compared with the correlation characteristic shown in FIG. 3, may be obtained depending on the manner of deterioration of the intake air flow rate sensor.

The correlation characteristic between the intake air flow rate QAIR and the air-fuel ratio correction coefficient KAF reflects not only a deterioration of the intake air flow rate sensor 19, but also a deviation of the basic fuel injection period TIM due to characteristic variations in mass-produced intake air flow rate sensors. Accordingly, by calculating the learning correction coefficient KREFG according to this correlation characteristic and applying the learning correction coefficient KREFG to Eq. (1), it is possible to compensate for not only a deterioration of the intake air flow rate sensor 19, but also an effect of characteristic variations in mass-produced intake air flow rate sensors.

In view of the above described points, an abnormality, for example, a condition where a degree of deterioration has increased, in the intake air flow rate sensor 19 is determined according to the correlation characteristic between the detected intake air flow rate QAIR and the air-fuel ratio correction coefficient KAF. Further, the learning correction coefficient KREFG is calculated according to the correlation characteristic between the detected intake air flow rate QAIR and the air-fuel ratio correction coefficient KAF. The air-fuel ratio is suitably corrected using the learning correction coefficient KREFG which is calculated according to a degree of deterioration that is judged as normal. Moreover, using the learning correction coefficient KREFG compensates for the effect of characteristic variations in mass-produced intake air flow rate sensors.

Figure 4:
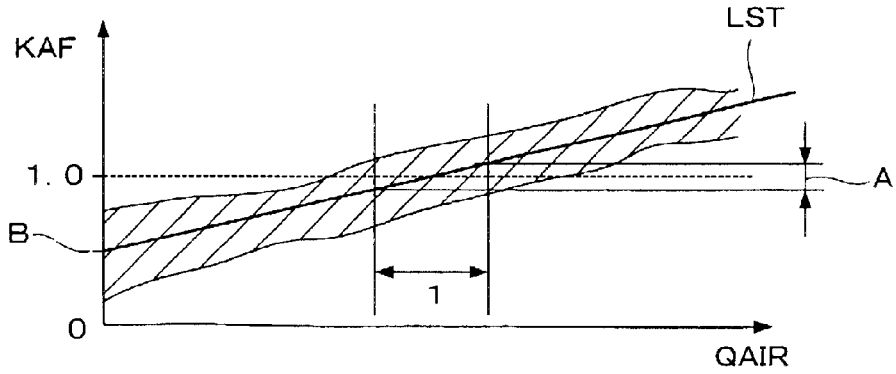
FIG. 4 is a graph showing a straight line (LST) approximating a correlation between the air-fuel ratio correction coefficient (KAF) and the intake air flow rate (QAIR) detected by the intake air flow rate sensor in an abnormal condition.

The correlation characteristic shown in FIG. 3 can be approximated by an expression corresponding to a straight line LST shown in FIG. 4. That is, the correlation characteristic can be defined by Eq. (2) shown below.

$$KAF(k)=A\times QAIR(k-d)+B \tag{2}$$

where A and B are correlation parameters defining the correlation characteristic. These correlation parameters A and B are calculated by the least square method. More specifically, the correlation parameter A corresponds to a slope of the straight line LST, and the correlation parameter B corresponds to the air-fuel ratio correction coefficient KAF when the intake air flow rate QAIR equals "0" as shown in FIG. 4. Further, "k" indicates a discrete time digitized with a control period, and "d" indicates a dead time period until the air-fuel ratio correction coefficient KAF reflects a change in the detected intake air flow rate QAIR. In other words, the dead time period "d" corresponds to a delay time period from the time the detected intake air flow rate QAIR changes, to the time the air-fuel correction coefficient KAF changes.

In general, when using the least square method, a large amount of data on the detected intake air flow rate QAIR(k) is required to calculate the correlation parameters A and B with high reliability. Accordingly, a large amount of data for computation of the correlation parameters must be stored in a memory.

Further, an inverse matrix computation is required to execute the least square method. As a result, the computation time period determined by the computing capacity of the CPU for the engine control becomes lengthy. This causes a problem in that the required computation cannot be finished while the vehicle is running (during engine operation). Likewise, other computations for the engine control cannot be executed. Although such problems may be avoided by providing an additional CPU dedicated to the inverse matrix computation, the manufacturing cost of the engine control unit may greatly increase.

Therefore, in this embodiment, a sequential identification algorithm, which is used for the adaptive control or the system identification, is employed to calculate the correlation parameters A and B. The sequential identification algorithm is an algorithm using a recurrence formula. More specifically, the sequential identification algorithm is an algorithm for calculating present values A(k) and B(k) of the correlation parameters, according to present values (the latest values) QAIR(k) and KAF(k) of the processing object data obtained in time series, and preceding values A(k−1) and B(k−1) of the correlation parameters.

When a correlation parameter vector θ (k) including the correlation parameters A and B as elements is defined by Eq. (3) shown below, the correlation parameter vector θ (k) is calculated from Eq. (4) shown below according to the sequential identification algorithm:

$$\theta(k)^T=[A(k)\ B(k)] \tag{3}$$

$$\theta(k)=\theta(k-1)+KP(k)\times eid(k) \tag{4}$$

where eid(k) is an identification error defined by Eqs. (5) and (6) shown below, and KP(k) is a gain coefficient vector defined by Eq. (7) shown below. P(k) in Eq. (7) is a second-order square matrix calculated from Eq. (8) shown below:

$$eid(k)=KAF(k)-\theta(k-1)^T\zeta(k) \tag{5}$$

$$\zeta^T(k)=[QAIR(k-d)1] \tag{6}$$

$$KP(k)=\frac{P(k)\zeta(k)}{1+\zeta^T(k)P(k)\zeta(k)} \tag{7}$$

$$P(k+1)=\frac{1}{\lambda 1}\left(E-\frac{\lambda 2P(K)\zeta(k)\zeta^T(k)}{\lambda 1+\lambda 2\zeta^T(k)P(k)\zeta(k)}\right)P(k) \tag{8}$$

where E is a unit matrix.

In accordance with the setting of coefficients λ1 and λ2 in Eq. (8), the identification algorithm from Eqs. (4) to (8) becomes one of the following four identification algorithms:

λ1=1, λ2=0 Fixed gain algorithm

λ1=1, λ2=1 Method-of-least-squares algorithm

λ1=1, λ2=λ Degressive gain algorithm
(λ takes a given value other than "0" and "1")

λ1=λ, λ2=1 Method-of-weighted-least-squares algorithm
(λ takes a given value other than "0" and "1")

In this embodiment, the method-of-weighted-least-squares algorithm is employed by setting the coefficient λ1 to a predetermined value λ falling between "0" and "1", and setting the coefficient λ2 to "1". Any one of the other algorithms may be adopted. Among these algorithms, the method-of-least-squares algorithm and the method-of-weighted-least-squares algorithm are suitable for the statistical processing.

According to the sequential identification algorithm by Eqs. (4) to (8), the inverse matrix computation, which is required for the batch operation type least square method mentioned above, is not required, and the values to be stored in the memory are only A(k), B(k), and P(k) (2×2 matrix). Accordingly, by using the sequential weighted least square method, the statistical processing operation can be simplified, and performed by the engine control CPU without using any special CPU for the statistical processing operation.

In the sequential weighted least square method, the correlation parameters can be calculated with a higher degree of accuracy by making the center of variations in the parameters (ζ, KAF), which is relevant to the calculation of the identification error eid, equal "0". Therefore, the identification error eid(k) in this embodiment is calculated from Eq. (5a) shown below instead of Eq. (5).

$$\mathrm{eid}(k)=(KAF(k)-1)-\theta(k-1)^T\zeta(k) \tag{5a}$$

By using Eq. (5a), the computation for obtaining the straight line LST shown in FIG. 4 is converted into the computation for obtaining a straight line LSTa shown in FIG. 5. As apparent from FIG. 5, the center of variations in the parameter (KAF(k)−1) becomes "0", so that the correlation parameters A and B can be obtained with a higher degree of accuracy.

Further, the correlation parameters A and B can be calculated more stably by limiting the values of the correlation parameters A(k) and B(k) so as to satisfy Eqs. (9) and (10) shown below:

$$AL<A(k)<AH \tag{9}$$

$$BL<B(k)<BH \tag{10}$$

where AL and AH are the lower limit and the upper limit of the correlation parameter A(k), respectively, and BL and BH are the lower limit and the upper limit of the correlation parameter B(k), respectively.

The determination of abnormality in the intake air flow rate sensor 19, using the correlation parameters will now be described.

Figure 6A:
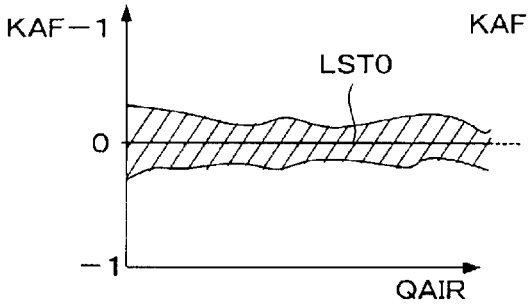
FIGS. 6A and 6B are graphs showing a relation between the parameter (KAF-1) and the intake air flow rate (QAIR) detected by the intake air flow rate sensor, in a normal condition and in an abnormal condition, respectively.
Figure 6B:
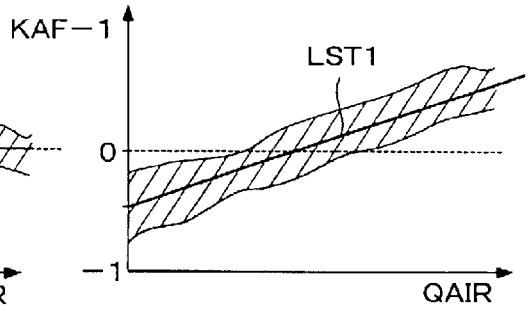

When the intake air flow rate sensor 19 is normal, a correlation characteristic as shown in FIG. 6A is obtained. In contrast, when the intake air flow rate sensor 19 is abnormal, for example, when the degree of deterioration due to dust adhesion or the like becomes large, a correlation characteristic as shown in FIG. 6B is obtained. That is, the slope A of a straight line LST0 shown in FIG. 6A changes, so that the straight line LST0 changes to a straight line LST1 shown in FIG. 6B. Accordingly, if the correlation parameter A(k) calculated by the above method is less than a determination threshold XQXNG (A(k)<XQXNG), it is determined that the intake air flow rate sensor 19 is normal. If the correlation parameter A(k) is greater than or equal to the determination threshold XQXNG (A(k)≧XQXNG), it is determined that the intake air flow rate sensor 19 is abnormal. The determination threshold XQXNG is experimentally set to a suitable value.

The calculation method for the learning correction coefficient KREFG will now be described.

Figure 5:
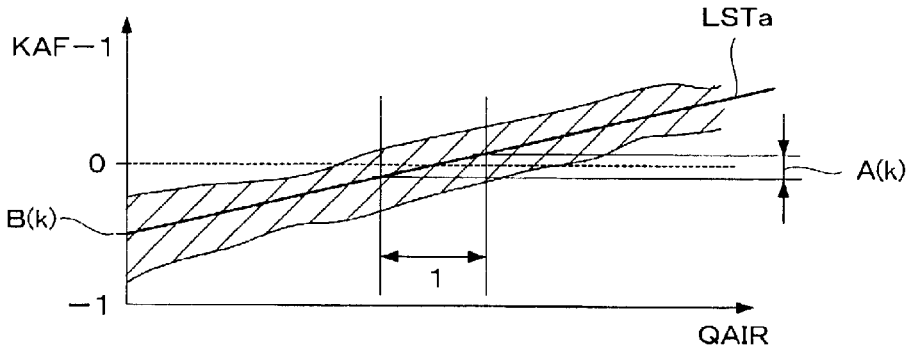
FIG. 5 is a graph showing a relation between a parameter (KAF-1) depending on the air-fuel ratio correction coefficient (KAF) and the intake air flow rate (QAIR) detected by the intake air flow rate sensor in an abnormal condition.

The straight line LSTa shown in FIG. 5 is expressed by Eq. (11) shown below:

$$\mathrm{KAF}-1=A(k)\times Q\mathrm{AIR}+B(k). \tag{11}$$

Eq. (11) is modified to Eq. (12) shown below:

$$\mathrm{KAF}=A(k)\times Q\mathrm{AIR}+B(k)+1. \tag{12}$$

Eq. (12) indicates the correlation characteristic between the detected intake air flow rate QAIR and the air-fuel ratio correction coefficient KAF as obtained by statistical processing, because the correlation parameters A(k) and B(k) are calculated by the weighted least square method. Accordingly, a statistically-estimated air-fuel ratio correction coefficient KAFE can be obtained from the right side of Eq. (12), when the detected intake air flow rate QAIR is given. Then, by defining this statistically-estimated air-fuel ratio correction coefficient KAFE as a learning correction coefficient KREFG, the learning correction coefficient KREFG can be calculated from Eq. (12a) shown below:

$$\mathrm{KREFG}=A(k)\times Q\mathrm{AIR}(k)+B(k)+1 \tag{12a}$$

By applying this learning correction coefficient KREFG to Eq. (1) to calculate the fuel injection period TOUT, the compensation by the air-fuel ratio correction coefficient KAF becomes unnecessary, even when the intake air flow rate sensor 19 is deteriorated. Accordingly, the air-fuel ratio correction coefficient KAF is maintained at a value near "1.0" similar to the case where the detected intake air flow sensor 19 is normal. As such, it is possible to prevent a deviation of the center of the air-fuel ratio feedback control.

However, when the learning correction coefficient KREFG calculated from Eq. (12a) is applied to Eq. (1), the following hunting of control occurs:

1) The slope of the straight line LST increases from "0" to a larger value (the correlation parameter A(k) increases).

→2) The learning correction coefficient KREFG increases from "1.0".

→3) The correlation parameter A(k) decreases to near "0".

→4) The learning correction coefficient KREFG returns to "1.0" (the slope of the straight line LST returns to "0").

→1) The slope of the straight line LST increases from "0" to a larger value (the correlation parameter A(k) increases).

To prevent this hunting, the air-fuel ratio correction coefficient KAF is not used for the calculation of the correlation parameters A(k) and B(k). Rather, a modified air-fuel ratio correction coefficient KAFMOD(k) calculated from Eq. (13) shown below is used.

$$KAF\mathrm{MOD}(k)=KAF(k)\times\mathrm{KREFG}(k-d) \tag{13}$$

Eq. (13) is obtained by counting the dead time period d until a change in the air-fuel ratio in the intake system due to an increase in the learning correction coefficient KREFG, is reflected via the LAF sensor 14 to the air-fuel ratio correction coefficient KAF.

Figure 7:
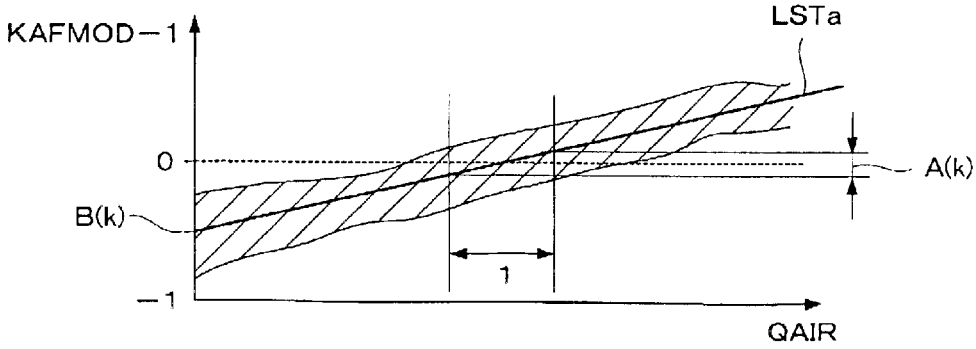
FIG. 7 is a graph showing a relation between a parameter (KAFMOD-1) depending on a modified air-fuel ratio correction coefficient (KAFMOD) and the intake air flow rate (QAIR) detected by the intake air flow rate sensor.

By adopting Eq. (11a), hown below, instead of Eq. (11), the correlation parameters A(k) and B(k) determining the correlation between a parameter (KAFMOD-1) and the detected intake air flow rate QAIR are calculated by the sequential least square method mentioned above. That is, the correlation parameters A(k) and B(k) defining a straight line LSTa shown in FIG. 7 are calculated.

$$KAF\text{MOD-1}=A(k)\times Q\text{AIR}+B(k) \tag{11a}$$

In this case, Eq. (5b), shown below, is used instead of Eq. (5a) to calculate the identification error eid(k). Then, by using Eq. (5b) and Eqs. (4) and (6) to (8), the correlation parameter vector θ (k) is calculated.

$$\text{eid}(k)=(KAF\text{MOD}(k)-1)-\theta(k-1)^T\zeta(k) \tag{5b}$$

In this manner, the correlation parameters A(k) and B(k) determining the correlation characteristic between the detected intake air flow rate QAIR and the parameter (KAFMOD-1) are first calculated, and the learning correction coefficient KREFG is next calculated from Eq. (12a) shown below.

$$\text{KREFG}=A(k)\times Q\text{AIR}+B(k)+1 \tag{12a}$$

Accordingly, the learning correction coefficient KREFG can be obtained with a higher degree of accuracy, without causing the hunting of control. By applying the learning correction coefficient KREFG thus obtained to Eq. (1), the control accuracy of the air-fuel ratio can be improved to thereby maintain good exhaust characteristics.

Figure 8:
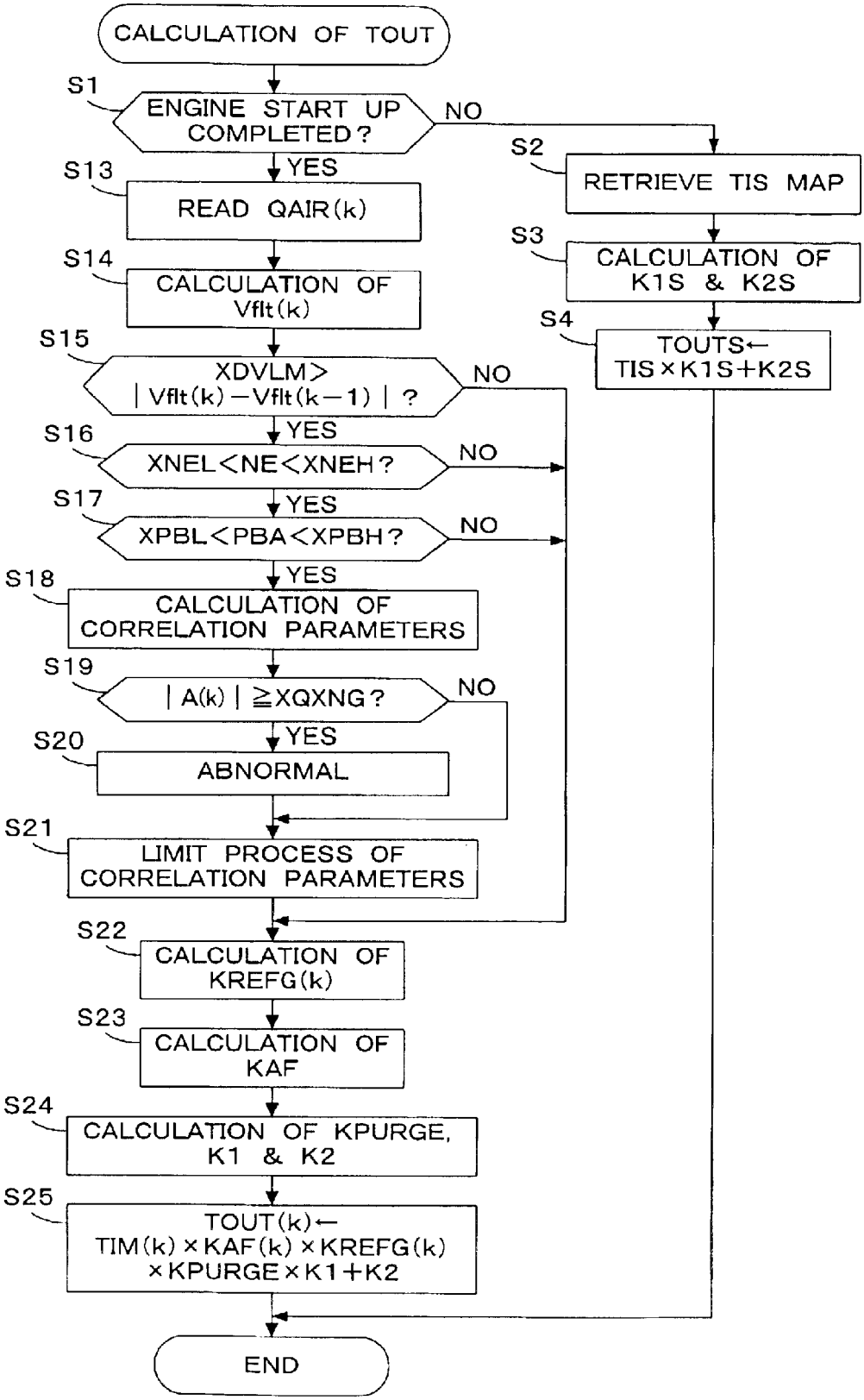
FIG. 8 is a flowchart showing a process for calculating a fuel injection period (TOUT)

FIG. 8 is a flowchart showing a process for calculating the correlation parameters A(k) and B(k) to calculate the learning correction coefficient KREFG using the above-described method, and calculating the fuel injection period TOUT using the calculated learning correction coefficient KREFG. Further, this process includes the determination of abnormality in the intake air flow rate sensor 19 according to the correlation parameter A(k). The process shown in FIG. 8 is executed by the CPU in the ECU 5 in synchronism with the generation of a TDC pulse.

In step S1, it is determined whether or not a startup of the engine 1 has been completed. If the startup of the engine 1 has not been completed, a TIS map which is set according to the engine rotational speed NE and the intake absolute pressure PBA is retrieved to calculate a basic fuel amount TIS for the startup of the engine (step S2). Next, a correction coefficient K1S and a correction variable K2S for the startup of the engine are calculated (step S3). A fuel injection period TOUTS for the startup of the engine is calculated from the Eq. (14) shown below (step S4). Thereafter, the process ends.

$$\text{TOUTS}=\text{TIS}\times\text{KIS}+\text{KIS} \tag{14}$$

If the startup of the engine 1 has been completed, the process proceeds from step S1 to step S13, in which the intake air flow rate QAIR detected by the intake air flow rate sensor 19 is read.

In step S14, the detected vehicle speed VP is subjected to a low-pass filtering process to calculate a vehicle speed filtered value Vf1t(k) from Eq. (15) shown below.

$$Vf\mathbf{1}t(k)=af\mathbf{1}\cdot Vf\mathbf{1}t(k)+\ldots+afn\cdot Vf\mathbf{1}t(k-n)+bf\mathbf{0}\cdot Vf\mathbf{0}t(k)+\ldots+bfm\cdot Vf\mathbf{1}t(k-m) \tag{15}$$

where af1 to afn and bf0 to bfm are the predetermined low-pass filter coefficients.

In step S15, it is determined whether or not the absolute value of the difference between a present value Vf1t(k) and a preceding value Vf1t(k−1) of the vehicle speed filtered value, is less than a predetermined vehicle speed change amount XDVLM (e.g., 0.8 km/h). If the answer to step S15 is negative (NO), the process proceeds to step S22. If the answer to step S15 is affirmative (YES), it is determined whether or not the engine rotational speed NE falls within the range of a predetermined upper limit XNEH (e.g., 4500 rpm) and a predetermined lower limit XNEL (e.g., 1200 rpm) (step S16). If the answer to step S16 is negative (NO), the process proceeds to step S22. If the answer to step S16 is affirmative (YES), it is then determined whether or not the absolute intake pressure PBA falls within the range of a predetermined upper limit XPBH (e.g., 86.7 kPa (650 mmHg)) and a predetermined lower limit XPBL (e.g., 54.7 kPa (410 mmHg)) (step S17). If the answer to step S17 is negative (NO), the process proceeds to step S22. If the answer to step S17 is affirmative (YES), the correlation parameter vector θ (k) (the correlation parameters A(k) and B(k)) is calculated from Eqs. (4), (5b), (6) to (8), and (11a).

In step S19, it is determined whether or not the correlation parameter A(k) is greater than or equal to a determination threshold XQXNG. If A(k) is less than XQXNG, the process proceeds directly to step S21. If A(k) is greater than or equal to XQXNG, it is determined that the intake air flow rate sensor 19 is abnormal (step S20). In this case, an alarm lamp is turned on to give an alarm to the driver of the vehicle.

In step S21, a limit process is executed so that the correlation parameters A(k) and B(k) satisfy Eqs. (9) and (10), respectively. That is, if Eq. (9) and/or Eq. (10) are not satisfied, the correlation parameter A(k) and/or the correlation parameter B(k) are modified so as to satisfy Eq. (9) and/or Eq. (10).

In step S22, the learning correction coefficient KREFG is calculated from Eq. (12a).

In step S23, the air-fuel ratio correction coefficient KAF is calculated by the air-fuel ratio feedback control according to an output from the LAF sensor 14. That is, the air-fuel ratio correction coefficient KAF is calculated so that the detected air-fuel ratio coincides with the target air-fuel ratio.

In step S24, the purge correction coefficient KPURGE, the correction coefficient K1 and the correction variable K2, which are applied to Eq. (1), are calculated. Finally, the fuel injection period TOUT is calculated from Eq. (1) (step S25).

According to this embodiment as described above, the correlation parameters A(k) and B(k) defining the correlation between the air-fuel ratio correction coefficient KAF and the detected intake air flow rate QAIR are calculated using the sequential statistical processing algorithm. By means of the sequential statistical processing algorithm, no special CPU for the statistical processing is required, and the correlation parameters A(k) and B(k) can be calculated by the statistical processing computation with a relatively small memory capacity.

Since the learning correction coefficient KREFG is calculated using the correlation parameters A(k) and B(k), the learning correction coefficient KREFG depending on changes in characteristics of the intake air flow rate sensor 19, can be obtained with a higher degree of accuracy over a wide range of the engine operating condition. Further, since the fuel injection period TOUT is calculated using the air-fuel ratio correction coefficient KAF and the learning correction coefficient KREFG, the control center of the air-fuel ratio correction coefficient KAF can be maintained at a value near "1.0", thereby maintaining good controllability.

Further, since the determination of an abnormality in the sensor 19 can be performed according to the correlation parameter A(k), the detection accuracy of the sensor 19 can be regurlary monitored, to thereby improve accuracy of the abnormality determination.

Further, the correlation parameters A(k) and B(k) are calculated in an operating condition where variations in the vehicle speed are small, and the engine rotational speed NE and the absolute intake pressure PBA fall within the respective ranges between the predetermined upper limits and the predetermined lower limits. Accordingly, the accuracy of the correlation parameters A(k) and B(k) is improved to thereby further improve accuracy of the learning correction.

In this embodiment, the ECU 5 constitutes the basic fuel amount calculating means, the air-fuel ratio correction coefficient calculating means, the fuel amount control means, the correlation parameter calculating means, the learning means, and the abnormality determining means. More specifically, step S23 in FIG. 8 corresponds to the air-fuel ratio correction coefficient calculating means. Step S18 in FIG. 8 corresponds to the correlation parameter calculating means. Step S22 in FIG. 8 corresponds to the learning means. Step S25 in FIG. 8 corresponds to the basic fuel amount calculating means and the fuel amount control means. Steps S19 and S20 in FIG. 8 correspond to the abnormality determining means.

Second Embodiment

Figure 9:
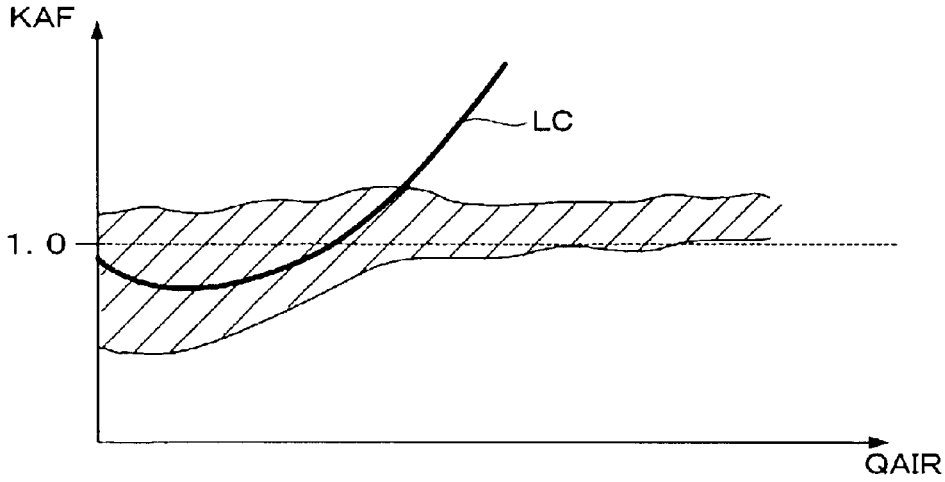
FIG. 9 is a graph illustrating a problem when one correlation is applied to the whole engine operating region.

FIG. 9 shows another example of the correlation characteristic between the detected intake air flow rate QAIR and the air-fuel ration correction coefficient KAF. According to this example, in the region where the detected intake air flow rate QAIR is small, an approximated correlation with a higher degree of accuracy is obtained by expressing the correlation characteristic with a quadratic curve LC. However, in the region where the detected intake air flow rate QAIR is large, the quadratic curve LC greatly deviates from the correlation, and does not show a correct correlation characteristic.

Figure 10:
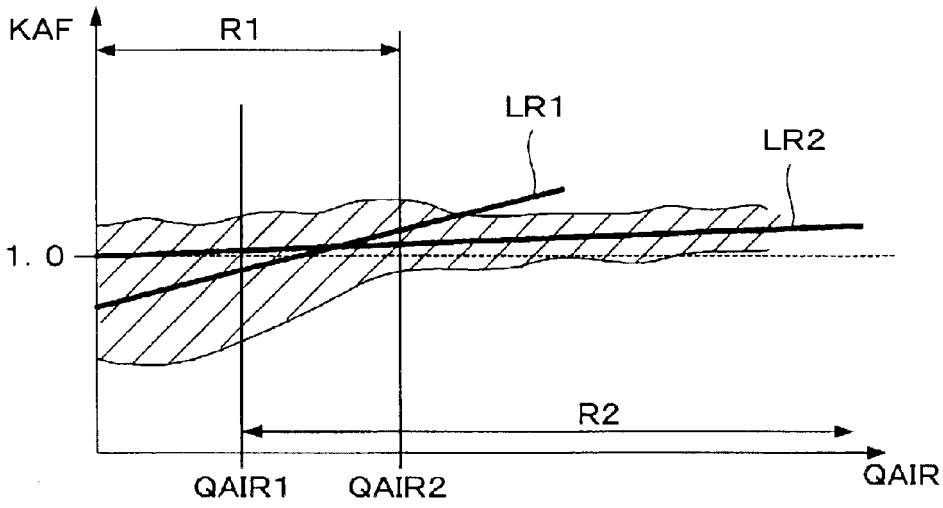
FIG. 10 is a graph illustrating an example in which the correlation is approximated by two straight lines.

Therefore, in this embodiment, as shown in FIG. 10, an engine operating region is divided into a first operating region R1 and a second operating region R2, according to the intake air flow rate QAIR, and straight lines LR1 and LR2, each of which approximates a correlation characteristic in each operating region, are obtained. In other words, a first correlation parameter vector θ1(k) and a second correlation parameter vector θ2(k) (see Eqs. (16) and (17) shown below) are calculated corresponding respectively to the first and second operating regions R1 and R2.

$$\theta 1^T(k)=[A1(k)\ B1(k)] \tag{16}$$

$$\theta 2^T(k)=[A2(k)\ B2(k)] \tag{17}$$

The first operating region R1 and the second operating region R2 are set to overlap each other. Predetermined intake air flow rates QAIR1 and QAIR2 in FIG. 10 are set respectively to 20 [g/sec] and 40 [g/sec], for example.

Figure 11A:
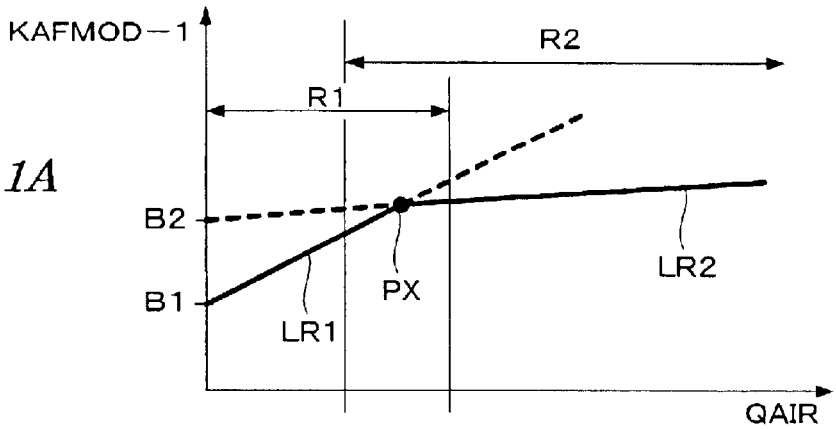
FIGS. 11A and 11B are graphs illustrating a selecting method of one straight line out of the two approximating straight lines.
Figure 11B:
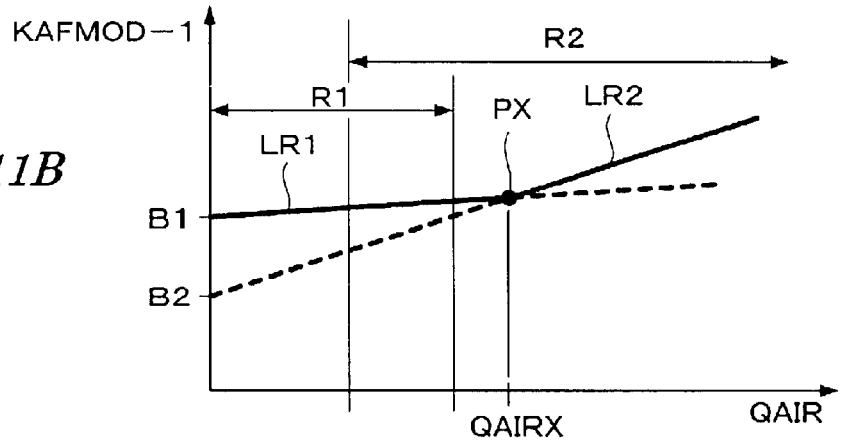

As described above, the correlation characteristic between the detected intake air flow rate QAIR and the air-fuel ratio correction coefficient KAF is defined by the two correlation parameter vectors θ1 and θ2 (two straight lines LR1 and LR2). The correlation parameter vector to be used for calculating the learning correction coefficient KREFG is switched at an intersection PX of the straight lines LR1 and LR2, as shown in FIGS. 11A and 11B. According to this switching method, the learning correction coefficient KREFG does not change abruptly when switching the correlation parameter vector, to thereby realize a smooth switching of the correlation parameter vector.

FIG. 11A shows an example in which the intersection PX is located in the overlapped region of the first operating region R1 and the second operating region R2, and FIG. 11B shows an example in which the intersection PX is located in the second operating region R2. As apparent from FIG. 11B, in the example where the intersection PX is located in the second operating region R2, the first correlation parameter vector θ1 is used in the second operating region R2 when the intake air flow rate QAIR is less than or equal to an intake air flow rate QAIRX corresponding to the intersection PX.

Figure 12:
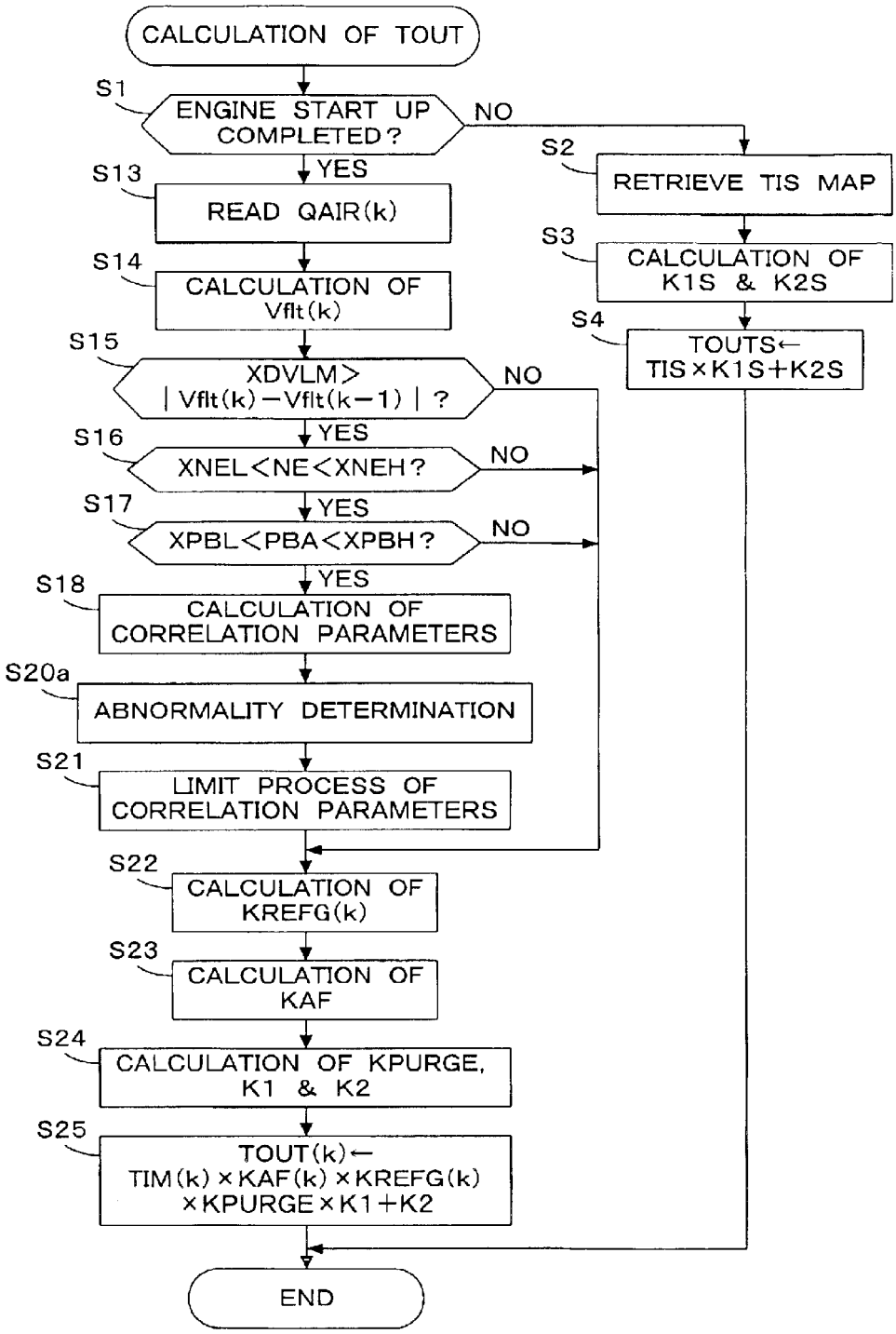
FIG. 12 is a flowchart showing a process of the second embodiment, for calculating a fuel injection period (TOUT)

FIG. 12 is a flowchart showing a process of calculating the correlation parameter vectors θ1(k) and θ2(k) and the learning correction coefficient KREFG according to the above-described method, and calculating the fuel injection period TOUT using the learning correction coefficient KREFG. In this process, the abnormality determination of the intake air flow rate sensor 19 is performed according to the correlation parameters A1(k) and A2(k). The process shown in FIG. 12 is executed in synchronism with the generation of a TDC pulse.

The process shown in FIG. 12 is obtained by deleting step S19 in FIG. 8, and replacing step S20 in FIG. 8 with step 20*a*. The process shown in FIG. 12 will be described mainly in the points which are different from the process shown in FIG. 8.

In step S18, according to the above-described Eqs. (4), (5b), (6)–(8), and (11a), the first correlation parameter vector θ1(k) is calculated (the correlation parameters A1(k) and B1(k) are calculated) in the first operating region R1, and the second correlation parameter vector θ2(k) is calculated (the correlation parameters A2(k) and B2(k) are calculated) in the second operating region R2.

In step S20*a*, the abnormality determination of the intake air flow rate sensor 19 is performed according to the correlation parameters A1(k) and A2(k). Specifically, it is determined whether or not an absolute value of the correlation parameter A1(k) is greater than or equal to a determination threshold XQXNG1, and it is determined whether or not an absolute value of the correlation parameter A2(k) is greater than or equal to a determination threshold XQXNG2. If |A1(k)| is greater than or equal to XQXNG1, or |A2(k)| is greater than or equal to XQXNG2, then the intake air flow rate sensor 19 is determined to be abnormal.

In step S21, a limit process is performed so that each of the correlation parameters A1(k), B1(k), A2(k), and B2(k) satisfies the condition expressed by the Eq. (9) or Eq. (10). That is, if one or more correlation parameters does not satisfy the Eq. (9) or Eq. (10), such correlation parameter(s) is(are) modified to satisfy the Eq. (9) or Eq. (10).

Figure 13:
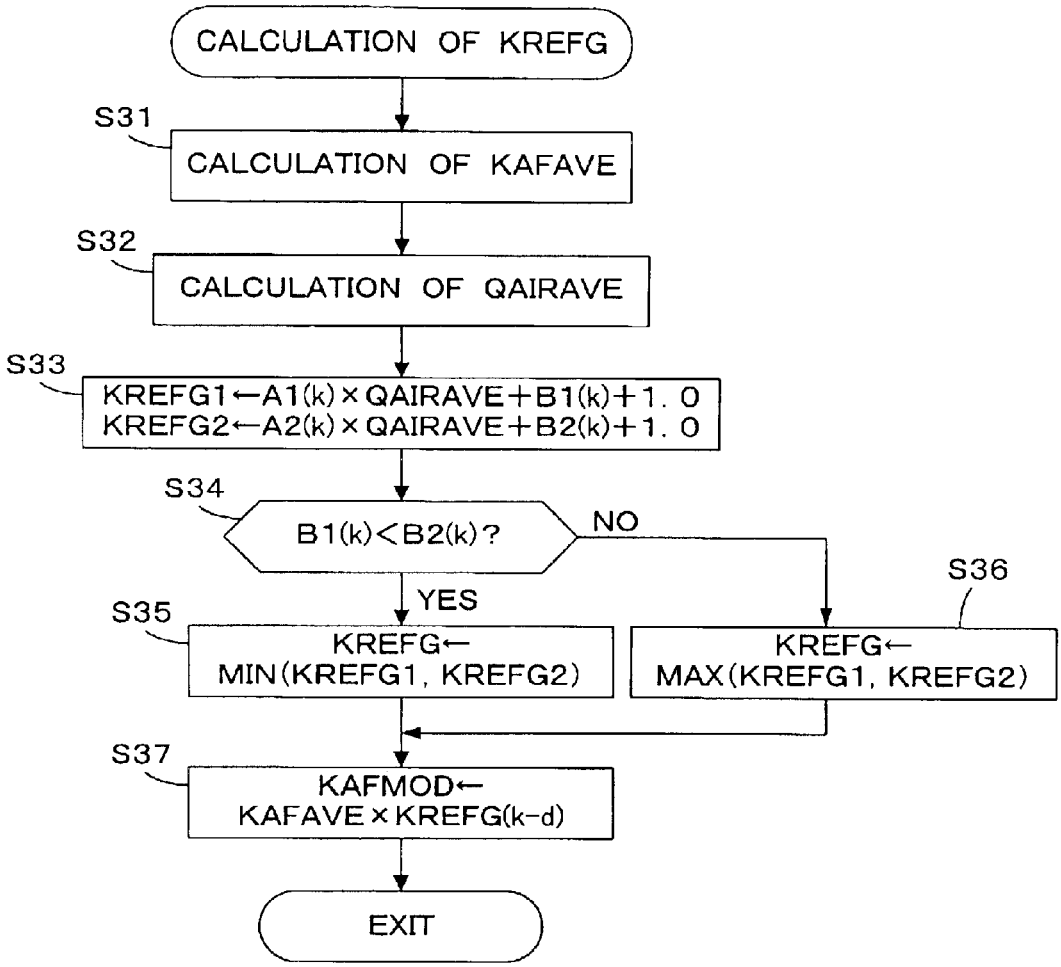
FIG. 13 is a flowchart showing a process for calculating a learning correction coefficient (KREFG)

FIG. 13 is a flowchart showing a process for calculating the learning correction coefficient KREFG in step S22 of FIG. 12.

In step S31, a moving average value KAFAVE of the air-fuel ratio correction coefficient KAF is calculated from Eq. (19) shown below:

$$KAFAVE=\sum_{i=0}^{N-1} KAF(k-i)/N \tag{19}$$

where "N" is set to "10", for example.

In step S32, a moving average value QAIRAVE of the intake air flow rate QAIR is calculated from Eq. (20) shown below:

$$QAIRAVE = \sum_{i=0}^{N-1} QAIR(k-i)/N. \quad (20)$$

In step S33, the moving average value QAIRAVE of the intake air flow rate and the elements of the first and second correlation parameter vectors θ1(k) and θ2(k) are applied to Eqs. (21) and (22) shown below to calculate a first operating region correction coefficient KREFG1 and a second operating region correction coefficient KREFG2.

$$\text{KREFG1}=A1(k)\times Q\text{AIRAVE}+B1(k)+1.0 \quad (21)$$

$$\text{i KREFG2}=A2(k)\times Q\text{AIRAVE}+B2(k)+1.0 \quad (22)$$

In step S34, it is determined whether or not the correlation parameter B1(k) is less than the correlation parameter B2(k). If B1(k) is less than B2(k) as shown in FIG. 11A, the learning correction coefficient KREFG is calculated by selecting smaller one of the first and second operating region correction coefficients KREFG1 and KRERG2 (step S35). Specifically, if KREFG1 is less than KREG2, the learning correction coefficient KREFG is set to KREFG1. If KREFG2 is less than KREG1, then the learning correction coefficient KREFG is set to KREFG2.

If B1(k) is greater than or equal to B2(k) as shown in FIG. 11B, the learning correction coefficient KREFG is calculated by selecting greater one of the first and second operating region correction coefficients KREFG1 and KRERG2 (step S36). Specifically, if KREFG1 is greater than KREG2, the learning correction coefficient KREFG is set to KREFG1. If KREFG2 is greater than KREG1, then the learning correction coefficient KREFG is set to KREFG2.

According to steps S34–S36, the correlation parameter vector, which is used for calculating the learning correction coefficient KREFG, is switched at the intersection PX of the straight lines LR1 and LR2.

In step S37, the moving average value KAFAVE of the air-fuel ratio correction coefficient and the learning correction coefficient KREFG(k−d), which is a learning correction coefficient KREFG stored the dead time period "d" before, are applied to Eq. 23 shown below to calculate the modified air-fuel ratio correction coefficient KAFMOD:

$$KAF\text{MOD}=KAF\text{AVE}\times K\text{REFG}(k-d). \quad (23)$$

According to the present embodiment described above, the engine operating region is divided into the first and second operating regions R1 and R2, and the first and second correlation parameter vectors θ1(k) and θ2(k) are calculated corresponding respectively to the first and second operating regions R1 and R2. That is, the correlation characteristic between the detected intake air flow rate QAIR and the parameter (KAFMOD−1) is approximated by the two straight lines LR1 and LR2. Accordingly, a correlation characteristic with a higher degree of accuracy compared with the case that the correlation characteristic is approximated by one straight line, is obtained in the whole engine operating region.

Further, since the learning correction coefficient KREFG is calculated using the first and second correlation parameter vectors θ1(k) and θ2(k), a learning correction coefficient KREFG with a higher degree of accuracy corresponding to a characteristic change in the intake air flow rate sensor 19 is obtained in a wide range of the engine operating condition.

Further, since the determination of abnormality in the sensor 19 is performed according to the correlation parameters A1(k) and A2(k), accuracy of the abnormality determination is improved.

In the present embodiment, step S23 in FIG. 12 corresponds to the air-fuel ratio correction coefficient calculating means. Steps S18 and S22 (the process shown in FIG. 13) correspond respectively to the correlation parameter calculating means and the learning means. Step S25 corresponds to the basic fuel amount calculating means and the fuel amount control means.

Other Embodiments

In the first embodiment, the correlation characteristic between the detected intake air flow rate QAIR and the parameter (KAFMOD−1) is approximated by a straight line. Alternatively, as shown in FIG. 9, the correlation characteristic may be approximated by a quadratic curve rather than a straight line. In this case, the correlation characteristic is approximated by Eq. (24) shown below.

$$KAF\text{MOD}-1=A(k)Q\text{AIR2}+B(k)Q\text{AIR}+C(k) \quad (24)$$

where the slope F of this approximate curve is given by Eq. (25) shown below.

$$F=2A(k)Qx+B(k) \quad (25)$$

When the correlation characteristic is approximated by the quadratic curve, the slope of this curve increases if the intake air flow rate sensor 19 is abnormal. Accordingly, if the slope F(=2A(k)QxM+B(k)) is greater than or equal to a predetermined threshold when the detected intake air flow rate QAIR equals an average value QAIRM, it may be determined that the intake air flow rate sensor 19 is abnormal.

In the second embodiment, the engine operating region is divided into two operating regions R1 and R2. Alternatively, the engine operating region may be divided into more than two operating regions. In such case, correlation parameter vectors may be calculated corresponding to three or more divided operating regions. Further, the engine operating region may be divided, not according to the detected intake air flow rate QAIR, but according to the engine rotational speed NE and the absolute intake pressure PBA.

Figure 14A:
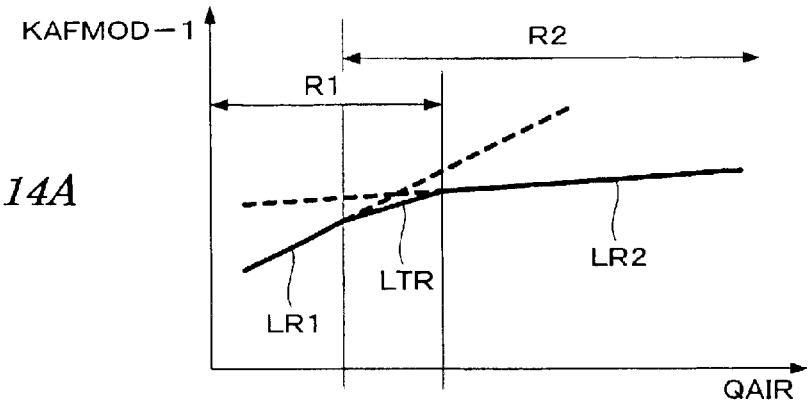
FIGS. 14A–14C show modifications of the selecting method shown in FIGS. 11A and 11B.
Figure 14B:
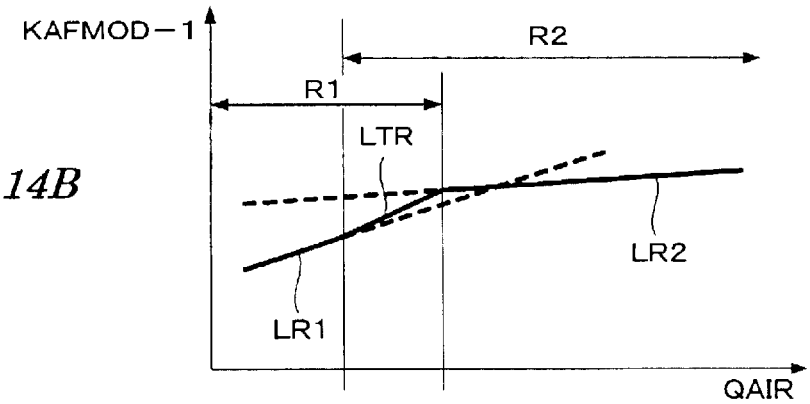

In the second embodiment, the correlation parameter vector to be used for calculating the learning correction coefficient KREFG can be switched at the intersection PX of the two straight lines LR1 and LR2. Alternatively, as shown in FIGS. 14A and 14B, in the overlapped region of the first and second operating regions R1 and R2, a correlation parameter vector θ TR corresponding to a transient straight line LTR which smoothly connects the two straight lines LR1 and LR2, may be calculated. In such case, the learning correction coefficient KREFG can be calculated using the correlation parameter vector θ TR.

Figure 14C:
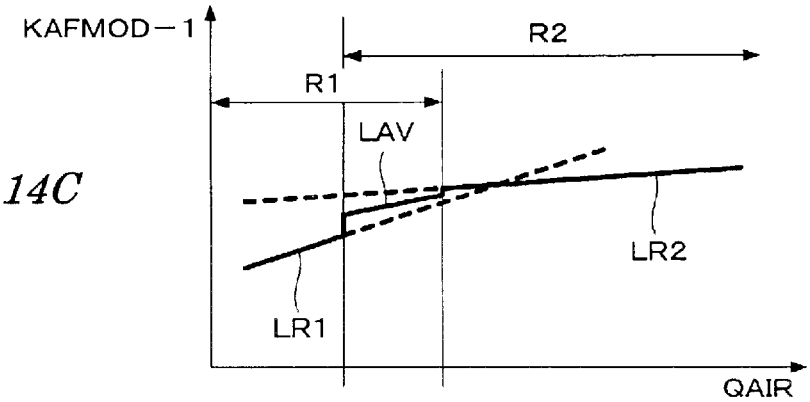

Further, as shown in FIG. 14C, in the overlapping region of the first and second operating regions R1 and R2, a correlation parameter vector θ AV corresponding to a averaged straight line LAV which is obtained by averaging the two straight lines LR1 and LR2, may be calculated. In such case, the learning correction coefficient KREFG can be calculated using the correlation parameter vector θ AV.

Further, in the first embodiment, it is determined whether or not the amount of change in the filtered value Vf1t of the vehicle speed VP is less than the predetermined vehicle speed change amount XDVLM in step S15 shown in FIG. 8. Alternatively, it may be determined whether or not an amount of change in a low-pass filtered value of the engine rotational speed NE is less than a predetermined change amount, and/or it may be determined whether or not an amount of change in a low-pass filtered value of the absolute intake pressure PBA is less than a predetermined change amount.

In this case, the process shown in FIG. 8 proceeds from step S15 to step S16 if the following conditions are met: if the amount of change in the low-pass filtered value of the engine rotational speed NE is less than the predetermined change amount; or if the amount of change in the low-pass filtered value of the absolute intake pressure PBA is less than the predetermined change amount; or if the amount of change in the low-pass filtered value of the engine rotational speed NE is less than the predetermined change amount and the amount of change in the low-pass filtered value of the absolute intake pressure PBA is less than the predetermined change amount.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A fuel supply control system for an internal combustion engine, comprising:

intake air flow rate detecting means for detecting an intake air flow rate of said engine;

basic fuel amount calculating means for calculating a basic fuel amount supplied to said engine according to the intake air flow rate detected by said intake air flow rate detecting means;

an air-fuel ratio detecting means for detecting an air-fuel ratio provided in an exhaust system of said engine;

air-fuel ratio correction coefficient calculating means for calculating an air-fuel ratio correction coefficient for correcting an amount of fuel to be supplied to said engine so that the air-fuel ratio detected by said air-fuel ratio detecting means coincides with a target air-fuel ratio;

correlation parameter calculating means for calculating at least one correlation parameter vector which defines a correlation between the air-fuel ratio correction coefficient and the intake air flow rate detected by said intake air flow rate detecting means, using a sequential statistical processing algorithm;

learning means for calculating a learning correction coefficient relating to a change in characteristics of said intake air flow rate detecting means, using the at least one correlation parameter vector; and fuel amount control means for controlling an amount of fuel to be supplied to said engine using the basic fuel amount, the air-fuel ratio correction coefficient, and the learning correction coefficient.

2. The fuel supply control system according to claim 1, further comprising abnormality determining means for determining an abnormality in said intake air flow rate detecting means according to an element of the at least one correlation parameter vector.

3. The fuel supply control system according to claim 1, wherein said correlation parameter calculating means calculates a plurality of correlation parameter vectors corresponding to a plurality of operating regions of said engine.

4. The fuel supply control system according to claim 3, wherein said correlation parameter calculating means calculates a plurality of correlation parameter vectors, each of which defines the correlation with a linear expression, and said learning means switches the at least one correlation parameter vector that is used for calculating the learning correction coefficient, at an intersection of straight lines corresponding to the linear expression.

5. The fuel supply control system according to claim 1, wherein said correlation parameter calculating means calculates the at least one correlation parameter vector, when said engine is operating in a predetermined operating condition.

6. The fuel supply control system according to claim 1, wherein said correlation parameter calculating means calculates a modified air-fuel ratio correction coefficient by modifying the air-fuel ratio correction coefficient with the learning correction coefficient, and calculates the at least one correlation parameter vector using the modified air-fuel ratio correction coefficient.

7. The fuel supply control system according to claim 1, wherein said correlation parameter calculating means calculates the at least one correlation parameter vector using a deviation between the air-fuel ratio correction coefficient and a central value of the air-fuel ratio correction coefficient.

8. The fuel supply control system according to claim 1, wherein said correlation parameter calculating means uses the sequential statistical processing algorithm, limiting values of elements of the at least one correlation parameter vector within a predetermined range.

9. A fuel supply control system for an internal combustion engine, comprising:

intake air flow rate detecting means for detecting an intake air flow rate of said engine;

basic fuel amount calculating means for calculating a basic fuel amount supplied to said engine, according to the intake air flow rate detected by said intake air flow rate detecting means;

an air-fuel ratio detecting means for detecting an air-fuel ratio provided in an exhaust system of said engine;

air-fuel ratio correction coefficient calculating means for calculating an air-fuel ratio correction coefficient for correcting an amount of fuel to be supplied to said engine so that the air-fuel ratio detected by said air-fuel ratio detecting means coincides with a target air-fuel ratio;

correlation parameter calculating means for calculating at least one correlation parameter vector which defines a correlation between the air-fuel ratio correction coefficient and the intake air flow rate detected by said intake air flow rate detecting means, using a sequential statistical processing algorithm;

fuel amount control means for controlling an amount of fuel to be supplied to said engine using the basic fuel amount and the air-fuel ratio correction coefficient; and abnormality determining means for determining an abnormality in said intake air flow rate detecting means according to an element of the at least one correlation parameter vector.

10. A fuel supply control method for an internal combustion engine, comprising the steps of:

a) detecting an intake air flow rate of said engine by an intake air flow rate sensor;

b) calculating a basic fuel amount supplied to said engine, according to the intake air flow rate detected by said intake air flow rate sensor;

c) detecting an air-fuel ratio of an air-fuel mixture to be supplied to said engine, by an air-fuel ratio sensor provided in an exhaust system of said engine;

d) calculating an air-fuel ratio correction coefficient for correcting an amount of fuel to be supplied to said engine so that the air-fuel ratio detected by said air-fuel ratio sensor coincides with a target air-fuel ratio;

e) calculating at least one correlation parameter vector which defines a correlation between the air-fuel ratio correction coefficient and the intake air flow rate detected by said intake air flow rate sensor, using a sequential statistical processing algorithm;

f) calculating a learning correction coefficient relating to a change in characteristics of said intake air flow rate sensor using the at least one correlation parameter vector; and g) controlling an amount of fuel to be supplied to said engine, using the basic fuel amount, the air-fuel ratio correction coefficient, and the learning correction coefficient.

11. The fuel supply control method according to claim 10, further comprising the step of determining an abnormality in said intake air flow rate sensor according to the at least one correlation parameter.

12. The fuel supply control method according to claim 10, wherein a plurality of correlation parameter vectors corresponding to a plurality of operating regions of said engine are calculated.

13. The fuel supply control method according to claim 12, wherein said plurality of correlation parameter vectors, each of which defines the correlation with a linear expression are calculated, and the at least one correlation parameter vector that is used for calculating the learning correction coefficient, is switched at an intersection of straight lines corresponding to the linear expression.

14. The fuel supply control method according to claim 10, wherein the at least one correlation parameter vector is calculated when said engine is operating in a predetermined operating condition.

15. The fuel supply control method according to claim 10, further comprising the step of calculating a modified air-fuel ratio correction coefficient by modifying the air-fuel ratio correction coefficient with the learning correction coefficient, wherein the at least one correlation parameter vector is calculated using the modified air-fuel ratio correction coefficient.

16. The fuel supply control method according to claim 10, wherein the at least one correlation parameter vector is calculated using a deviation between the air-fuel ratio correction coefficient and a central value of the air-fuel ratio correction coefficient.

17. The fuel supply control method according to claim 10, wherein the sequential statistical processing algorithm is used, limiting values of elements of the at least one correlation parameter vector within a predetermined range.

18. A fuel supply control method for an internal combustion engine, comprising the steps of:

a) detecting an intake air flow rate of said engine by an intake air flow rate sensor;

b) calculating a basic fuel amount supplied to said engine, according to the intake air flow rate detected by said intake air flow rate sensor;

c) detecting an air-fuel ratio of an air-fuel mixture to be supplied to said engine, by an air-fuel ratio sensor provided in an exhaust system of said engine;

d) calculating an air-fuel ratio correction coefficient for correcting an amount of fuel to be supplied to said engine so that the air-fuel ratio detected by said air-fuel ratio sensor coincides with a target air-fuel ratio;

e) calculating at least one correlation parameter vector which defines a correlation between the air-fuel ratio correction coefficient and the intake air flow rate detected by said intake air flow rate sensor, using a sequential statistical processing algorithm;

f) controlling an amount of fuel to be supplied to said engine using the basic fuel amount and the air-fuel ratio correction coefficient; and g) determining an abnormality in said intake air flow rate sensor according to the at least one correlation parameter.

19. A computer program embodied in a computer-readable medium causing a computer to carry out a fuel supply control method for an internal combustion engine, said fuel supply control method comprising the steps of:

a) detecting an intake air flow rate of said engine by an intake air flow rate sensor;

b) calculating a basic fuel amount supplied to said engine, according to the intake air flow rate detected by said intake air flow rate sensor;

c) detecting an air-fuel ratio of an air-fuel mixture to be supplied to said engine, by an air-fuel ratio sensor provided in an exhaust system of said engine;

d) calculating an air-fuel ratio correction coefficient for correcting an amount of fuel to be supplied to said engine so that the air-fuel ratio detected by said air-fuel ratio sensor coincides with a target air-fuel ratio;

e) calculating at least one correlation parameter vector which defines a correlation between the air-fuel ratio correction coefficient and the intake air flow rate detected by said intake air flow rate sensor, using a sequential statistical processing algorithm;

f) calculating a learning correction coefficient relating to a change in characteristics of said intake air flow rate sensor, using the at least one correlation parameter vector; and g) controlling an amount of fuel to be supplied to said engine using the basic fuel amount, the air-fuel ratio correction coefficient, and the learning correction coefficient.

20. The computer program according to claim 19, wherein said fuel supply control method further comprises the step of determining an abnormality in said intake air flow rate sensor according to the at least one correlation parameter.

21. The computer program according to claim 19, wherein a plurality of correlation parameter vectors corresponding a plurality of operating regions of said engine are calculated.

22. The computer program according to claim 21, wherein said plurality of correlation parameter vectors, each of which defines the correlation with a linear expression are calculated, and the at least one correlation parameter vector that is used for calculating the learning correction coefficient, is switched at an intersection of straight lines corresponding to the linear expression.

23. The computer program method according to claim 19, wherein the at least one correlation parameter vector is calculated when said engine is operating in a predetermined operating condition.

24. The computer program according to claim 19, wherein said fuel supply control method further comprises the step of calculating a modified air-fuel ratio correction coefficient by modifying the air-fuel ratio correction coefficient with the learning correction coefficient, and the at least one correlation parameter vector is calculated using the modified air-fuel ratio correction coefficient.

25. The computer program according to claim 19, wherein the at least one correlation parameter vector is calculated, using a deviation between the air-fuel ratio correction coefficient and a central value of the air-fuel ratio correction coefficient.

26. The computer program according to claim 19, wherein the sequential statistical processing algorithm is used, limiting values of elements of the at least one correlation parameter vector within a predetermined range.

27. A computer program embodied in a computer-readable medium causing a computer to carry out a fuel supply control method for an internal combustion engine, said fuel supply control method comprising the steps of:

a) detecting an intake air flow rate of said engine by an intake air flow rate sensor;

b) calculating a basic fuel amount supplied to said engine, according to the intake air flow rate detected by said intake air flow rate sensor;

c) detecting an air-fuel ratio of an air-fuel mixture to be supplied to said engine, by an air-fuel ratio sensor provided in an exhaust system of said engine;

d) calculating an air-fuel ratio correction coefficient for correcting an amount of fuel to be supplied to said engine so that the air-fuel ratio detected by said air-fuel ratio sensor coincides with a target air-fuel ratio;

e) calculating at least one correlation parameter vector which defines a correlation between the air-fuel ratio correction coefficient and the intake air flow rate detected by said intake air flow rate sensor using a sequential statistical processing algorithm;

f) controlling an amount of fuel to be supplied to said engine using the basic fuel amount and the air-fuel ratio correction coefficient; and g) determining an abnormality in said intake air flow rate sensor according to the at least one correlation parameter.

* * * * *